United States Patent [19]

Dugan

[11] Patent Number: 4,798,234

[45] Date of Patent: Jan. 17, 1989

[54] CAN FILLING SYSTEM

[75] Inventor: Larry M. Dugan, Boulder, Colo.

[73] Assignee: Adolph Coors Company, Golden, Colo.

[21] Appl. No.: 126,112

[22] Filed: Nov. 27, 1987

Related U.S. Application Data

[62] Division of Ser. No. 881,649, Jul. 3, 1986, Pat. No. 4,718,465.

[51] Int. Cl.[4] ..... B65B 35/10

[52] U.S. Cl. ..... 141/165; 141/145; 141/372

[58] Field of Search ..... 198/480.1, 481.1, 803.3; 141/143, 144, 145, 165, 146-152, 168, 369, 372, 378, 135, 137, 139-142

[56] References Cited

U.S. PATENT DOCUMENTS

| | | | |
|---|---|---|---|
| 1,046,048 | 12/1912 | Bastian | 141/165 X |
| 1,434,766 | 11/1922 | Babcock | 141/165 X |
| 1,882,225 | 10/1932 | Meyer | 141/165 X |
| 2,466,731 | 4/1949 | Nordquist | 141/146 X |
| 2,773,522 | 12/1956 | Meyer | 141/165 |
| 2,837,127 | 6/1958 | Luther | 141/146 X |
| 3,040,787 | 6/1962 | Knoll | 141/146 X |
| 3,052,269 | 9/1962 | Manas | 141/146 X |
| 3,116,765 | 10/1964 | Guckel | 141/145 |
| 3,245,436 | 4/1966 | Burgert, Jr. | 141/165 |
| 3,502,120 | 3/1970 | Rydstrom | 141/165 |
| 4,664,159 | 5/1987 | Dugan | 141/1 |
| 4,718,465 | 1/1988 | Dugan | 141/89 |
| 4,721,200 | 1/1988 | Dugan | 198/480.1 |

*Primary Examiner*—Henry J. Recla
*Assistant Examiner*—Ernest G. Cusick
*Attorney, Agent, or Firm*—Klaas & Law

[57] ABSTRACT

Apparatus for attachment to a can filler unit which apparatus functions to properly locate a can in relation to a filling apparatus so as to minimize any possible damage to a can and to provide a support for a sealing and pressure relief member when the can filling system is being cleaned.

7 Claims, 3 Drawing Sheets

CAN FILLING SYSTEM

This application is a division of application Ser. No. 881,649, filed 7/3/86, now U.S. Pat. No. 4,718,465, Jan. 12, 1985.

FIELD OF THE INVENTION

This invention relates generally to can filling systems and more particularly to a can filling system incorporating apparatus which functions to both minimize any possible damage to a can as the can filling apparatus is being positioned in a can and to provide a seal and pressure relief means when the can filler unit is being cleaned.

BACKGROUND OF THE INVENTION

Beverage containers, such as beverage cans, are filled with beverages such as beer, soft drinks, etc., in a can filling machine just prior to application of the top of the can in a seamer machine. In order to increase productivity and speed of production, can filling machines have been designed to operate at high speeds. Typical high speed can filling machines are capable of filling cans at a rate of 1,800 cans per minute. At such high rates of filling, occasional damage occurs to the cans which causes the cans to leak. Leaking cans are normally readily identifiable by quality control personnel. However, occasionally a slow leaking can will be produced because of improper seaming as a result of slight indentations or deformations of the flange portion of the can.

Corrections of the problems caused by slow leaking cans can be quite expensive. Typically, slow leaking cans are not discovered until they are packaged in a multiple packaging container and sometimes not until they are palletized for shipment. If leaks occur after the cans have been packaged and palletized, the leaking can must be located and replaced and the packaging material must be either cleaned or replaced.

Under normal operating procedures, it is necessary that the can filler units be cleaned at periodic intervals. Since it is highly desirable to hold machine downtime to a minimum, an efficient cleaning system for the can filler units is highly desirable. Also, in the past, this cleaning requirement has prevented the location of the upper can pocket means at the more desirable locations.

SUMMARY OF THE INVENTION

This invention provides apparatus for attachment to a can filler unit which apparatus functions both to minimize any possible damage to a can while the can filling apparatus is being positioned in the can and to provide a seal and a pressure relief means when the can filler unit is being cleaned.

In the preferred embodiment for minimizing any possible damage to a can while the can filling apparatus is being positioned in the can, an infeed conveyor transports a plurality of cans, such as beverage containers, from a source of cans and transfers the cans in a sequential manner into a star wheel. The star wheel moves the cans in a semi-circular path and deposits the cans in a sequential manner to a rotating filler wheel means. The rotating filler wheel means is provided with a first pocket means located to contact each can placed therein at surface areas adjacent to the bottom of the cans and extending upwardly therefrom and a second pocket means located to contact each can placed therein at surface areas adjacent to the neck of the can and extending downwardly therefrom. The first pocket means is mounted on a horizontal surface of the rotating filler wheel means. The second pocket means comprises a portion of apparatus secured to each can filler unit located on the rotating filler wheel means. This wide spacing between the first pocket means and the second pocket means functions to ensure that the longitudinal axis of each can is substantially vertical. A guide brush is mounted adjacent to the rotating filler wheel means and has a surface having a radius of curvature slightly less than the radius of curvature of the outermost portion of the outer surface of the cans when seated against the first and second pocket means. The guide brush extends from a location adjacent to where the star wheel transfers each can to the rotating filler wheel means to a location where the can is securely positioned in the can filler unit. The first and second pocket means and the guide brush ensures that the longitudinal axis of each can coincides with the longitudinal axis of each filler unit so as to minimize any possible damage to the can as the can filling apparatus is positioned in the can.

When the can filling system is being cleaned, a sealing means having pressure relief means associated therewith is supported on a surface of the apparatus secured to each can filler unit. The surface is located above the second pocket means. The sealing means includes a support member having a tubular shaped body portion with a threaded bore extending therethrough. A flange projects outwardly in a radial direction from one end of the tubular body portion and is supported on the surface of the apparatus. A sealing member is provided and has an annular groove formed therein. A sealing ring is seated in the annular groove and projects radially outwardly therefrom. The sealing member has a threaded bore extending therethrough. The pressure relief means comprises a pressure relief valve having at one end thereof a threaded portion adapted to mate with the threaded bore in the sealing member and at a central location, a threaded portion adapted to mate with the threaded bore of the tubular shaped body portion. The sealing means is assembled by securing the sealing member to the pressure relief valve in a completely tightened relationship so that there can be no relative rotational movement therebetween. The pressure relief valve is then threaded into the threaded bore of the tubular shaped body portion so that relative movement therebetween is possible. The sealing means is then supported on the surface of the apparatus. The sealing member is rotated while the tubular shaped body portion is held stationary so that the threaded connection between the pressure relief valve and the threaded bore in the tubular shaped body portion causes the sealing member to be moved toward a tapered portion of the inner surface of the can filler unit. This movement is continued until the sealing ring is in contact position with the tapered portion of the inner surface of the can filler unit. The rotation is continued until the friction between the sealing ring and the tapered portion of the inner surface prevents further rotation of the sealing member. The tubular body portion is then rotated in a counter-clockwise direction to move the sealing member in an axial direction so that the sealing ring moves over the tapered portion to provide a seal between the slanted portion of the inner surface of the can filler unit and the sealing member.

It is an object of this invention to provide apparatus which can be attached to a can filler unit and provide functions for use when a can is being filled and when the can filler unit is being cleaned.

It is another object of this invention to provide a can filling system having means for minimizing any possible damage to the cans during the positioning of the can filling apparatus into the can.

It is a further object of this invention to provide sealing means for the tulip during a cleaning operation and pressure relief means to remove any high pressure which might damage the filling apparatus.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

DESCRIPTION OF THE PREFERRED EMBODIMENT

Figure 1:
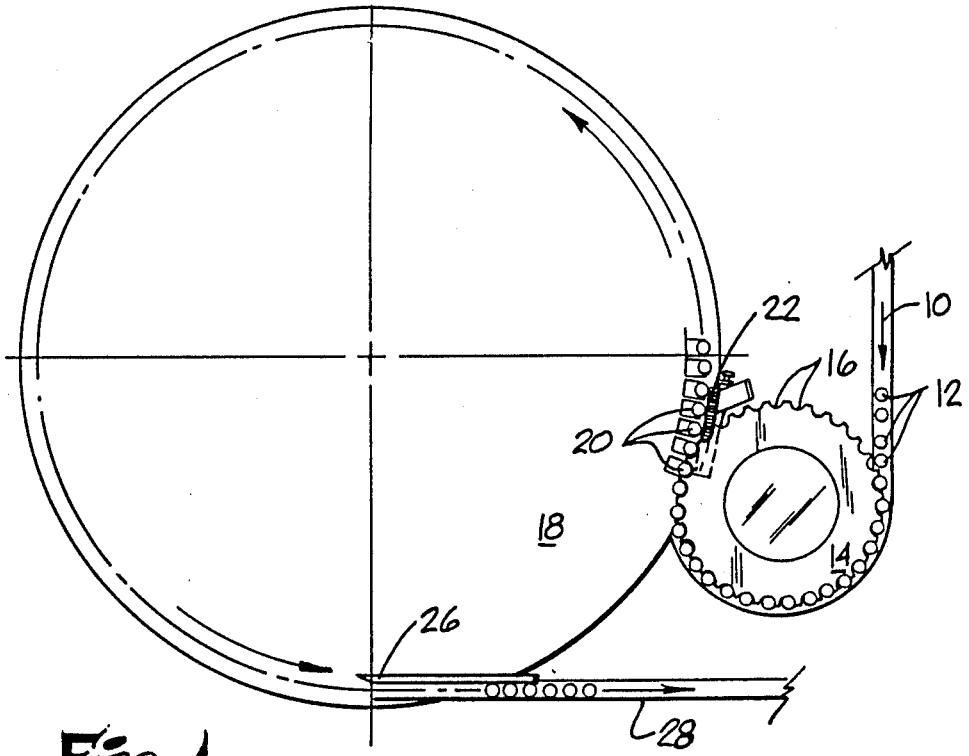
FIG. 1 is a plan view schematically illustrating a can filling system.
Figures 2, 3:
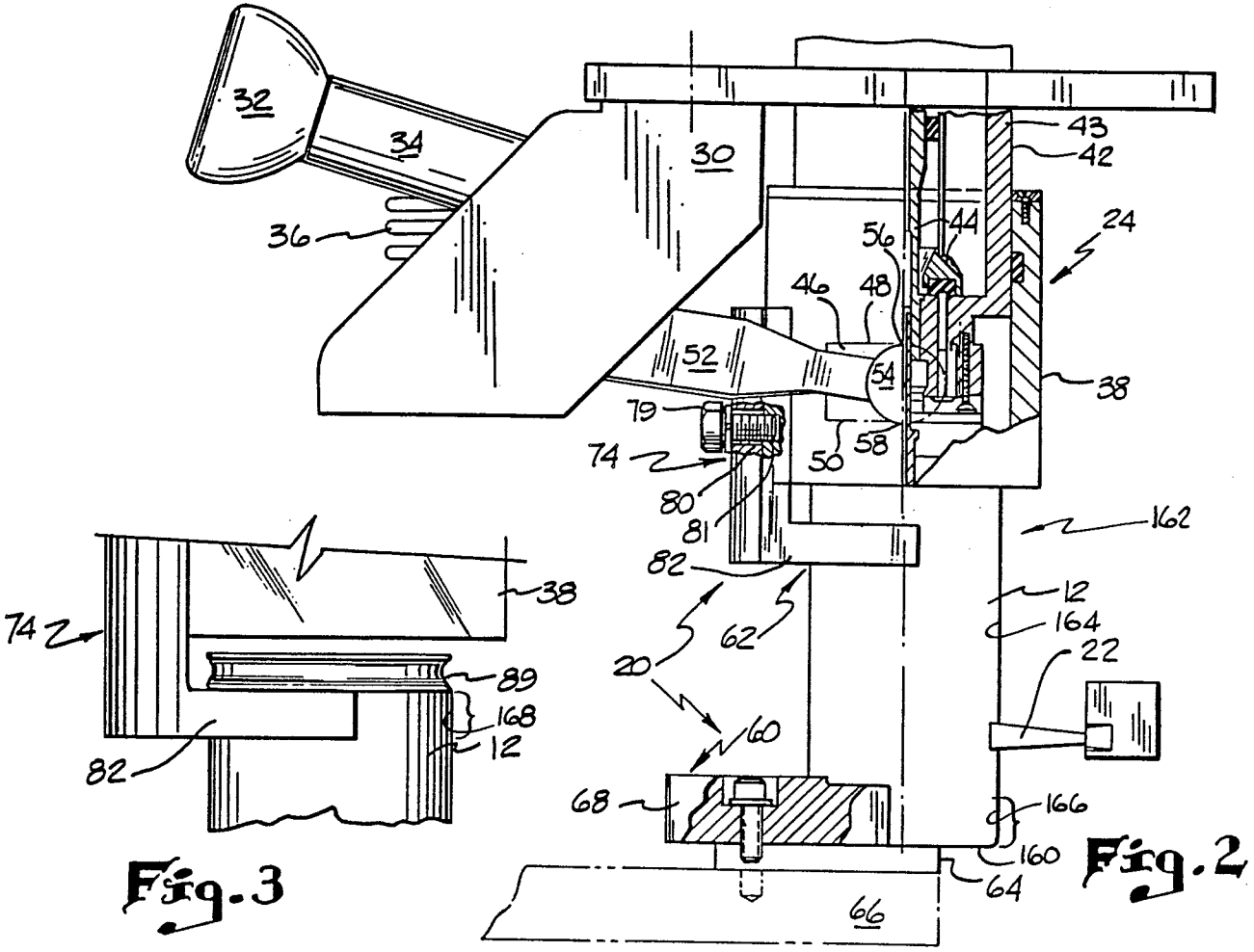
FIGS. 2 and 3 are side elevational views schematically illustrating the location of various components during the positioning of a can.

FIG. 1 is a schematic plan view of the device of the present invention. Infeed conveyor 10 transports a plurality of cans 12, such as beverage containers, from a source of cans in a sequential manner to a star wheel 14. Star wheel pockets 16 engage cans 12 from infeed conveyor 10 and transport the cans in a semi-circular path to rotating filler wheel means 18. Star wheel 14 transfers cans 12 to filler wheel pockets 20 at the point at which the tangents of star wheel 14 and rotating filler wheel 18 meet. A guide brush assembly 22 has a radius of curvature slightly less than the radius defined by curvature of the outermost portion of the outer surfaces of the cans 12 as they rotate with the filler wheel means 18 and induces a force in an inward radial direction relative to rotating filler wheel means 18 to hold each can 12 in a filler wheel pocket 20. A filling system 24; FIG. 2, is cammed down onto the top of cans 12 while guide brush 22 maintains cans 12 in filler wheel pockets 20 to ensure that the cans 12 are maintained in a constant vertical orientation. During and subsequent to the filling process, cans 12 are transported around the rotating filler wheel means 18 until they are diverted by diverter guide 26 onto discharge conveyor 28 which leads to a can seamer.

A portion of a filling system 24 is schematically illustrated in FIG. 2 and comprises a support 30 fixedly mounted on the filler wheel means 18. A cam follower roller 32 is rotatably mounted on a pivotally mounted arm 34 and is biased against a barrel cam (not shown) by spring 36. A tulip 38 is mounted for reciprocation along a vertical axis 40 over the outer surface 42 of a housing 43 of the can filling system. Conventional beverage filling apparatus 44 is mounted in the housing 43. A groove 46 is formed in the outer surface of the tulip 38 and has an upper planar surface 48 and a lower planar surface 50. A pivotally mounted arm 52 extends outwardly from the support 30 and terminates in a cam 54 having contacting relationship with the planar surfaces 48 and 50 at 56 and 58. The arm 52 is moved by the arm 34 by conventional means (not shown) in response to the movement generated by the cam follower roller 32 to move the tulip 38 in reciprocal movement along the vertical axis 40 into and out of sealing engagement with the top of the can.

The pocket means 20 comprises a plurality of lower pocket means 60 and a plurality of upper pocket means 62 located in a side by side relationship around the periphery of the rotating filler wheel means 18. Each lower pocket means comprises a platform 64 secured to a fixed base 66 of the rotating filler wheel means to provide a horizontal surface for supporting a can 12. Mounted on top of the platform 64 is a member 68 having an opening 70 in one side thereof so as to provide an arcuate surface 72 extending in a vertical direction. The arcuate surface 72 has a high tolerance semicircular shape with its longitudinal axis coinciding with the vertical axis 40.

Each upper pocket means 62 comprises a plate 74 having an inner surface 76 having a configuration corresponding to the configuration of the outer surface 78 of the tulip 38 so that there may be a mating relationship therebetween. Suitable means are used to secure the plate 74 to the tulip 38, such as a threaded bolt 79 passing through an opening 80 in the plate 74 and received in a threaded hole 81 in the outer surface 78 of the tulip 38. A member 82 projects inwardly from the plate 74 at the lower end thereof so as to form a unitary planar bottom surface 84 lying generally in a horizontal plane. An opening 86 is formed in the member 74 so as to provide an arcuate surface 88 extending in a vertical direction. The arcuate surface 88 has a high tolerance semicircular shape with its longitudinal axis coinciding with the vertical axis 40.

In operation, cans 12 are fed in a sequential manner to the star wheel 14 and then transferred into the filler wheel pockets 20. Each can 12, as illustrated in FIGS. 2 and 3, has a bottom portion 160 and a body portion 162 having a cylindrical outer surface 164 having a lower portion 166 adapted to be moved into contact with the arcuate surface 72 and an upper portion 168 adapted to be contacted by the arcuate surface 88. As illustrated in FIG. 2 each can 12 is in engagement with the lower pocket means 60 and the upper pocket means 62. When a can 12 is first fed into the filler wheel pocket 20, the upper pocket means 62 is in the position illustrated in FIG. 3 so that the arcuate surface 88 contacts the outer surface of the can 12 immediately below the neck portion 89. At the same time, the lower portion of the can 12 adjacent to the bottom thereof is in contact with the arcuate surface 72 of the lower pocket means 60. The widely spaced apart pocket means provides for proper alignment of the longitudinal axis of each can 12 with the vertical axis 40 along which the tulip 38 is reciprocated. The guide brush 22 functions to maintain the can 12 in position in the filler wheel pockets 20. As illustrated in FIG. 2, the housing 38 has moved downwardly over the can 12 and holds the can 12 in proper position during the filling operation. Also, the member 82 has been moved downwardly.

Figure 6:
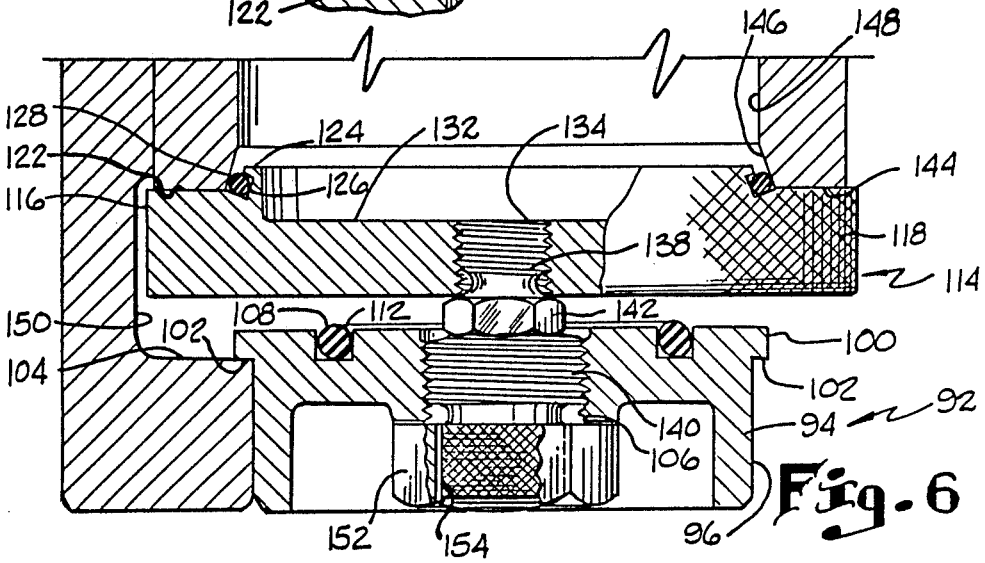
FIG. 6 is a side elevational view with parts in section of the seal means.
Figure 5:
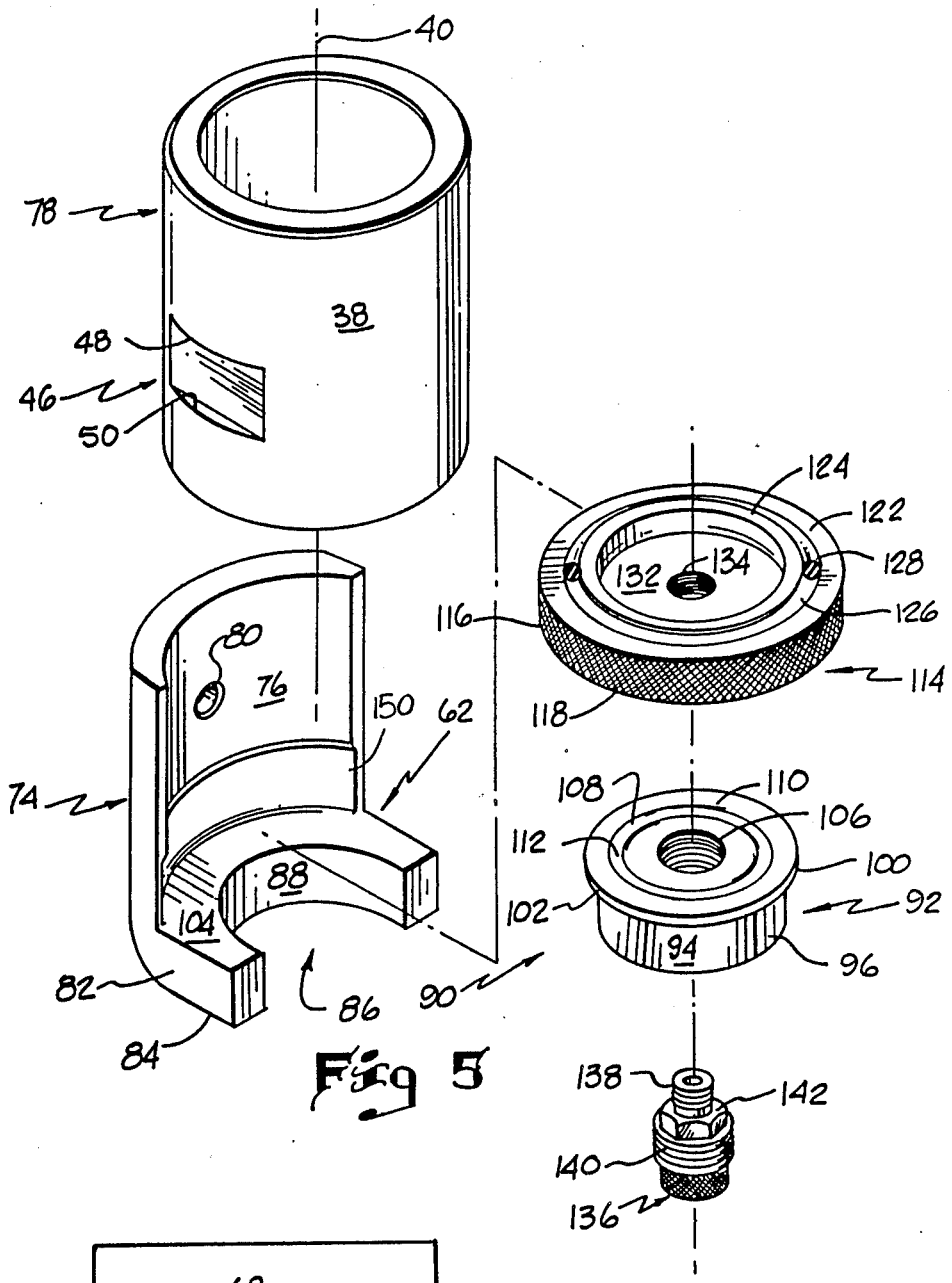
FIG. 5 is an exploded view of various components of the invention.
Figure 4:
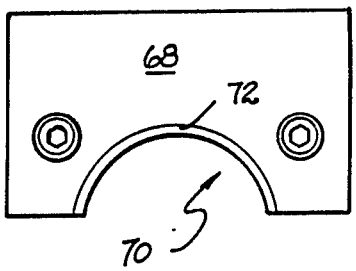
FIG. 4 is a top plan view of the lower pocket means.

At periodic intervals, it is necessary to clean the can filling apparatus. Therefore, it is necessary to provide a seal means 90, illustrated in FIGS. 5–7, for sealing the tulip 38. Each seal means 90 comprises a support member 92 having a body portion 94 having a substantially cylindrical surface 96 having substantially the same diameter as the arcuate surface 88 so as to mate therewith. A flange 100 projects outwardly in a radial direction from the upper portion of the body portion 94 and has a surface 102 extending at a right angle to the body portion 94. A generally planar surface 104 is provided on the member 82 which planar surface 104 is generally parallel to the bottom surface 84 of the member 82 and is adapted to be contacted by the surface 102 of the flange 100 so a to support the support member 92. A central threaded bore 106 extends through the support member 92. An annular recess 108 is formed in the upper surface 110 of the support member 92 and a separating gasket 112 is seated therein to prevent surface contact between the support member 92 and the sealing member 114.

The sealing member 114 has a generally cylindrical outer surface 116 which is provided with knurls 118. The sealing member 114 has a generally planar annular ring shaped surface 122 and an annular projection 124 having a generally radially outwardly opening groove 126 formed therebetween. A sealing gasket 128 is seated in the groove 126 and has a thickness sufficiently great so that an annular portion of the sealing gasket 128 projects out of the groove 126. The sealing member 114 is provided with a recess 132 to accommodate the filling apparatus 44. A central threaded bore 134 extends through the sealing member 114. A pressure relief valve 136 is provided and has an externally threaded portion 138 for threaded engagement with the threaded bore 134 and a second section housing an externally threaded portion 140 for engagement with the threaded bore 106. The pressure relief valve 136 is also provided with a hexagonal nut 142 for a purpose described below.

The tulip 38 has a generally planar bottom surface 144 and a tapered portion 146 of the inner surface 148 adapted to contact the sealing gasket, as described below. The plate 74 is provided with a recessed portion 150 to accommodate the outer periphery of the sealing member 114.

Figure 7:
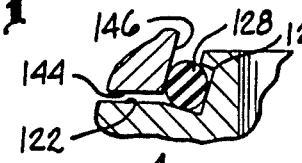
FIG. 7 is a partial cross-sectional view illustrating the location of components prior to obtaining a seal.

When it is desired to perform a cleanup operation, the seal means 90 is assembled by threading the threaded portion 138 of the pressure relief valve 136 into the threaded bore 134 and securing it in position using the hexagonal nut 142. The support member 92 is then assembled by threading the threaded bore 106 onto the threaded portion 140. The assembled seal means 90 is then supported on the surface 104 by placing the surface 102 of the flange 100 thereon. The sealing member 114 is rotated in the clockwise direction and the threaded portions 140 and 106 function to move the sealing member 114 axially toward the bottom surface 144 of the housing 38. The force is applied to the sealing member 114 using the knurls 118. Rotation of the sealing member 114 is continued until the sealing gasket 128 is in contact with the tapered portion 146 of the inner surface 148 of the housing 38. The rotation is continued until the friction between the sealing gasket 128 and the tapered portion 146 of the inner surface 148 prevents further rotation of the sealing member 114. As illustrated in FIG. 7, the rotation of the sealing member 114 has stopped with the planar annular ring shaped surface 122 spaced a small distance below the planar bottom surface 144 of the housing 38. The support member 92 is then rotated in a counter-clockwise direction and the "threaded sections" 140 and 106 function to move the sealing member 114 in an axially direction to apply addition forces on the sealing gasket 128 so as to form a complete seal between the tapered portion 146 of the inner surface 148 and the bottom surface of the groove 126. If desired, the support member 92 is provided with a nut like member 152 so that a tool can be used to apply a force to turn the support member 92 in the counter-clockwise direction. The nut like member 152 has an inner cylindrical surface 154 having a diameter greater than the pressure relief valve 136 so as to permit relative rotation therebetween.

It is contemplated that the inventive concepts herein described may be variously otherwise embodied and it is intended that the appended claims be construed to include alternative embodiments of the invention except insofar as limited by the prior art.

What is claimed is:

1. A can filling system for minimizing damaged cans during filling comprising:

rotating filler wheel means having support means for supporting a plurality of cans, each of said cans having a longitudinal axis extending in a vertical direction;

each of said cans having a bottom portion, a body portion having a cylindrical outer surface, an open top rim portion and a neck portion between said body portion and said open top rim portion;

said cylindrical outer surface of said body portion having a lower portion and an upper portion;

said rotating filler wheel means transporting said cans in a horizontal circular path;

first pocket means on said rotating filler wheel means located adjacent to but spaced from said support means for positioning said cans on said support means;

said first pocket means having at least one arcuate surface having a longitudinal axis extending in a vertical direction;

can filler units supported on said rotating filler wheel means each of said can filler units having a generally cylindrical outer surface having a longitudinal axis aligned with the longitudinal axis of said first pocket means;

each of said can filler units having tulip means having a cylindrical inner surface and mounted for reciprocation over said outer surface of said can filler units for moving into and out of sealing engagement with one of said cans on said support means;

said tulip means having a longitudinal axis aligned with said longitudinal axis of said first pocket means;

second pocket means for cooperating with said first pocket means in positioning said cans;

mounting means for mounting each of said second pocket means on each of said tulip means for movement therewith;

said second pocket means having at least one arcuate surface having a longitudinal axis extending in a vertical direction and aligned with said longitudinal axis of said tulip means;

star wheel means for transporting said cans to said rotating filler wheel means;

star wheel pocket means for transferring each of said cans onto said support means said lower portion of said cylindrical outer surface in contact with said arcuate surface of said first pocket means and said upper portion of said cylindrical outer surface in contact with said arcuate surface of said second pocket means with portions of said longitudinal axis of each of said cans coinciding with said longitudinal axis of said arcuate surface of said first and second pocket means;

means for moving each of said tulip means into sealing engagement with each of said cans and at the same time moving said second pocket means over said outer surface of said each of said cans; and force applying means for applying a force to each of said cans during said movement of said tulip means and said second pocket means to maintain the contacting relationship between said upper and lower portions of said cylindrical outer surface of said can body and the arcuate surfaces of said first and second pocket means.

2. A system as in claim 1 wherein each of said arcuate surfaces of said first and said second pocket means comprises:

a high tolerance semi-circular shape having a diameter substantially the same as the diameter of the outer surface of each of said cans.

3. A system as in claim 2 wherein said force applying means comprises:

a guide brush mounted so as to contact the outer surface of said cans on said rotating filler wheel means;

said guide brush having an arcuate surface having a radius of curvature concentric to the radius of curvature of said rotating filler wheel means;

said cans when on said support means having an outermost portion on said outer surfaces thereof for defining a radius of curvature as they rotate with said rotating filler wheel means; and said-radius of curvature of said guide brush is slightly less than the radius of curvature of the outermost portions of said outer surfaces of said cans as they rotate with the filler wheel means.

4. A system as in claim 2 wherein said means for mounting each of said second pocket means on each of said tulip means comprises:

said tulip means having an outer surface configuration;

a plate having an inner surface configuration corresponding to said outer surface configuration of at least a portion of each of said tulip means;

a bottom surface on each of said tulip means;

a portion of said plate extending below said bottom surface on said one of said tulip means; and said second pocket means projecting from said portion of said plate and spaced a predetermined distance below said bottom surface on said tulip means.

5. A system as in claim 4 wherein: said bottom surface of said tulip means lying generally in a horizontal plane;

a top surface on said second pocket means; and said top surface on said second pocket means lying in a plane generally parallel to said horizontal plane.

6. A system as in claim 1 wherein:

said second pocket means having an uppermost and lowermost portion;

the uppermost portion of said arcuate surface of said second pocket means contacts said upper portion of said cylindrical outer surface of each of said cans at a location immediately adjacent to the neck portion of each can when said can filling unit is in a non-filling position.

7. A system as in claim 6 wherein:

said first pocket means having an uppermost and a lowermost portion; and the lowermost portion of said arcuate surface of said first pocket means contacts the lowermost portion of said lower portion of said cylindrical outer surface of each of said can body portions.

* * * * *